United States Patent [19]

Walker

[11] Patent Number: 4,809,352

[45] Date of Patent: Feb. 28, 1989

[54] INFLATABLE COOLER

[76] Inventor: Kyle B. Walker, 4322 Martindale, Garland, Tex. 75043

[21] Appl. No.: 125,872

[22] Filed: Nov. 27, 1987

[51] Int. Cl.[4] ..... B65D 30/00

[52] U.S. Cl. ..... 383/3; 206/522; 220/425

[58] Field of Search ..... 383/3; 206/522, 541, 206/545; 220/425

[56] References Cited

U.S. PATENT DOCUMENTS

| | | | |
|---|---|---|---|
| 196,945 | 11/1963 | Tibbets | D58/17 |
| 283,845 | 5/1986 | Lief et al. | D3/30.1 |
| 2,580,879 | 1/1952 | Belokin, Jr. | 150/48 |
| 2,751,953 | 6/1956 | Grimm | 150/0.5 |
| 3,006,396 | 10/1961 | Cushman | 150/0.5 |
| 3,389,824 | 6/1968 | Berchtold | 220/9 |
| 3,643,268 | 2/1972 | Stamberger | 206/522 X |
| 3,742,994 | 7/1973 | Pensak | 150/1 |
| 3,910,461 | 10/1975 | Eager | 222/131 |
| 4,044,867 | 8/1977 | Fisher | 206/522 X |
| 4,085,785 | 4/1978 | Hoot | 150/0.5 |
| 4,091,852 | 5/1978 | Jordan et al. | 383/3 |
| 4,679,242 | 7/1987 | Brockhaus | 206/522 X |

*Primary Examiner*—Stephen P. Garbe
*Assistant Examiner*—Nova Stucker

[57] ABSTRACT

This invention comprises an inflatable cooler having an inflatable container and an inflatable lid. Secured to the bottom wall of the inflatable container is a reinforcing member for supporting the weight of objects carried by the container. The reinforcing member may be removable and foldable, to facilitate storage when the cooler is deflated. The shape of the container and lid is maintained as desired by one or more support strips secured within the walls of the container and within the lid.

19 Claims, 4 Drawing Sheets

FOLDING PROCESS

INFLATABLE COOLER

TECHNICAL FIELD

This invention relates to insulated containers for foods and beverages and more specifically to an inflatable cooler.

BACKGROUND AND SUMMARY

Traditionally, foods and beverages consumed on picnics, outings and the like have been kept cool and transported in insulated coolers. Such coolers typically are manufactured from insulating materials surrounded by hard plastic or sometimes even metal shells to provide longevity. Coolers so constructed are undesirable in that they are relatively heavy, particularly when packed with food, beverages and ice. In addition, when not used, such coolers consume valuable storage space.

The present invention eliminates the foregoing disadvantages by providing an inflatable cooler which is light-weight and which may be collapsed for storage when not in use. The cooler includes an inflatable container and lid that provide air-space insulation for foods and beverages contained by the cooler. For storage following use, the cooler is deflated, collapsed and folded into a relatively small volume. In one aspect of the invention, a bottom wall of the cooler is reinforced with a foldable support which can be removed and folded for storage. Alternatively, the cooler can be collapsed onto the support, and then folded with the support for storage.

BRIEF DESCRIPTION OF THE DRAWINGS

The features of the present invention may be best understood by referring to the following description in connection with the accompanying drawings in which.

DETAILED DESCRIPTION

Figure 1:
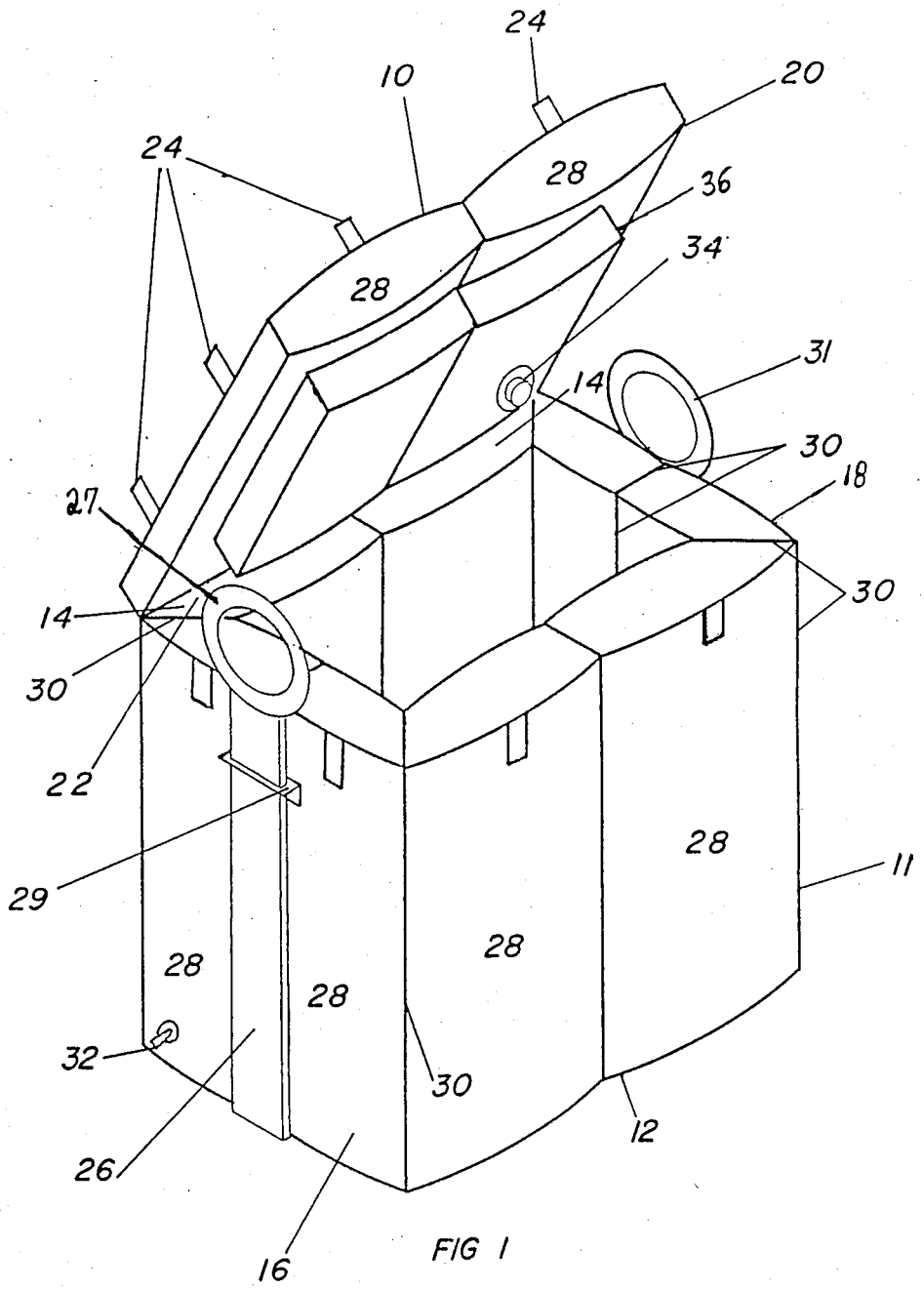
FIG. 1 is a perspective view showing the front and side of a cooler embodying the invention, wherein the cooler lid is raised.

Referring to FIGS. 1 through 5, an inflatable cooler 10 embodying the present invention is shown. The cooler 10 is rectangular and includes a container 11 for storing food, beverages and the like, constructed from inflatable front and rear walls 12 and 14, inflatable side walls 16 and 18, and an inflatable bottom wall 19. An inflatable lid 20 is secured by a hinge 22 of flexible material to the top of the rear wall 14, forming a hinged closure for the container 11. Thermal insulation for the contents of the cooler is provided by the air space within the front and rear walls 12 and 14, side walls 16 and 18, bottom wall 19 and lid 20.

Velcro® fasteners 24, or other suitable securing means, are located about the perimeter of the lid 20, the front wall 12 and the side walls 16 and 18 for securing the lid 20 in a closed position. A carrying strap 26, comprising a continuous length of webbed nylon, or other flexible material, is secured about the underside of the container 11 and along the side walls 16 and 18 by a pair of brackets 29 and 33 (bracket 33 is shown only in FIGS. 3–5). The ends of the strap 26 form carrying handles 27 and 31.

The brackets 29 and 33 and lid 20 are constructed to allow slippage of the strap 26 relative to the side walls 16 and 18 and to the brackets 29 and 33 themselves. Such construction avoids deformation of the container 11 which would otherwise be caused by stress imparted from the strap 26 to the side walls 16 and 18 of the container.

The front and rear walls 12 and 14, side walls 16 and 18, bottom wall 19 and lid 20 each include a pair of inflatable panels 28. The panels 28 are constructed of vinyl, plastic or other impermeable, flexible material, which provides an air-tight skin. Adjacent panels 28 are secured together at seams 30 by thermal sealing, adhesive, or by other well-known means. It will be apparent that virtually any number of panels 28 may be used to construct the front and rear walls 12 and 14, side walls 16 and 18, bottom wall 19, and lid 20, depending upon the size of the cooler 10 desired or other design criteria.

Inflation and deflation of the container 11 and lid 20 is accomplished by means of valves 32 and 34, respectively. All panels 28 of the container 11 are in fluid communication with each other, as are the panels 28 of the lid 20. Thus, the entire container 11 and lid 20 can be inflated or deflated through the valves 32 and 34, respectively.

The panels 28 of the lid 20 each include inflatable extension portions 36, which are also in fluid communication with the panels to which they are secured. The extension portions 36 protrude outwardly from the panels 28 of the lid 20 when the lid 20 is inflated. As is perhaps best shown in FIG. 4, the extension portions 36 (shown by broken lines) extend into and fit snugly within the container 11 (interior surfaces shown by broken lines) when the lid 20 is closed, to prevent the lid 20 from sliding on the upper edges of the container 11 and to assist in sealing the interior of the container 11.

Figure 7:
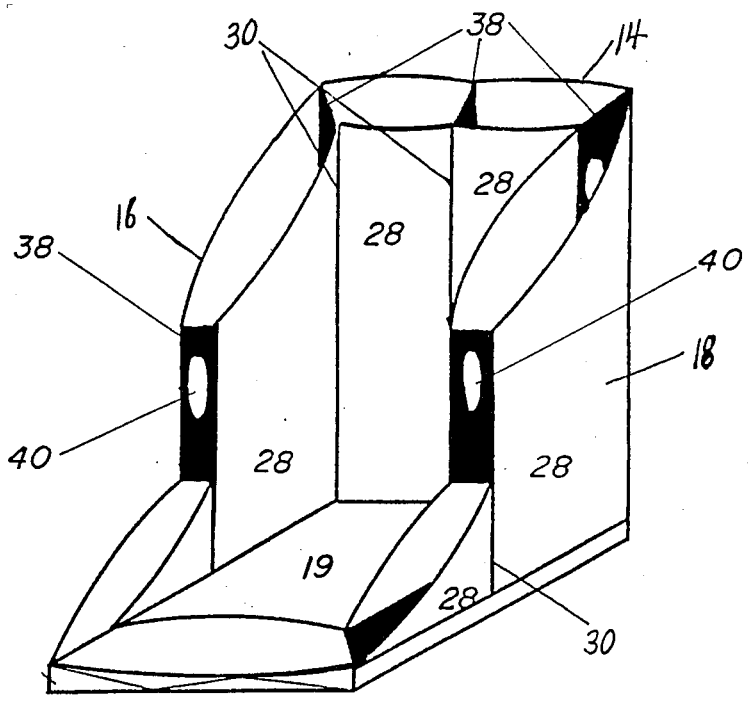
FIG. 7 is a partial sectional view of a lower portion of the cooler.
Figure 6:
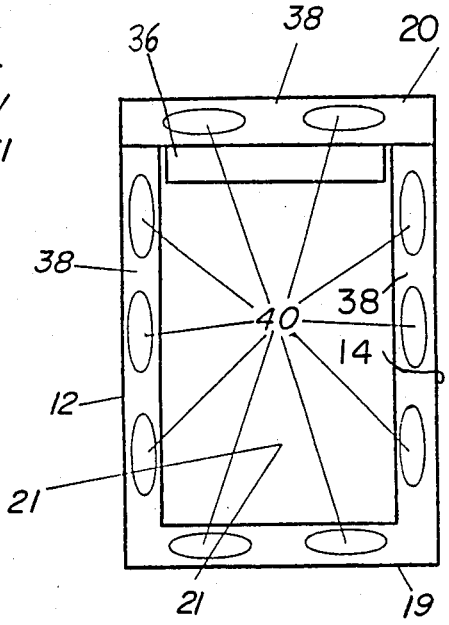
FIG. 6 is a section view of the cooler, taken along section line 6—6 in FIG. 4.

FIGS. 6 and 7 illustrate the internal construction of the cooler 10. Secured along each seam 30 adjoining adjacent panels 28 is a support strip 38. The support strips 38 are secured along the seams 30 by suitable means, such as adhesive, thermal sealing, and the like. The support strips 38 maintain a desired shape of the container 11 and lid 20 and prevent excessive expansion of the container 11 and lid 20 when the cooler 10 is fully inflated. Each of the support strips 38 includes one or more apertures 40, which allow circulation of air through all panels of the container 11 and lid 20 as the cooler 10 is inflated and deflated.

Figure 2:
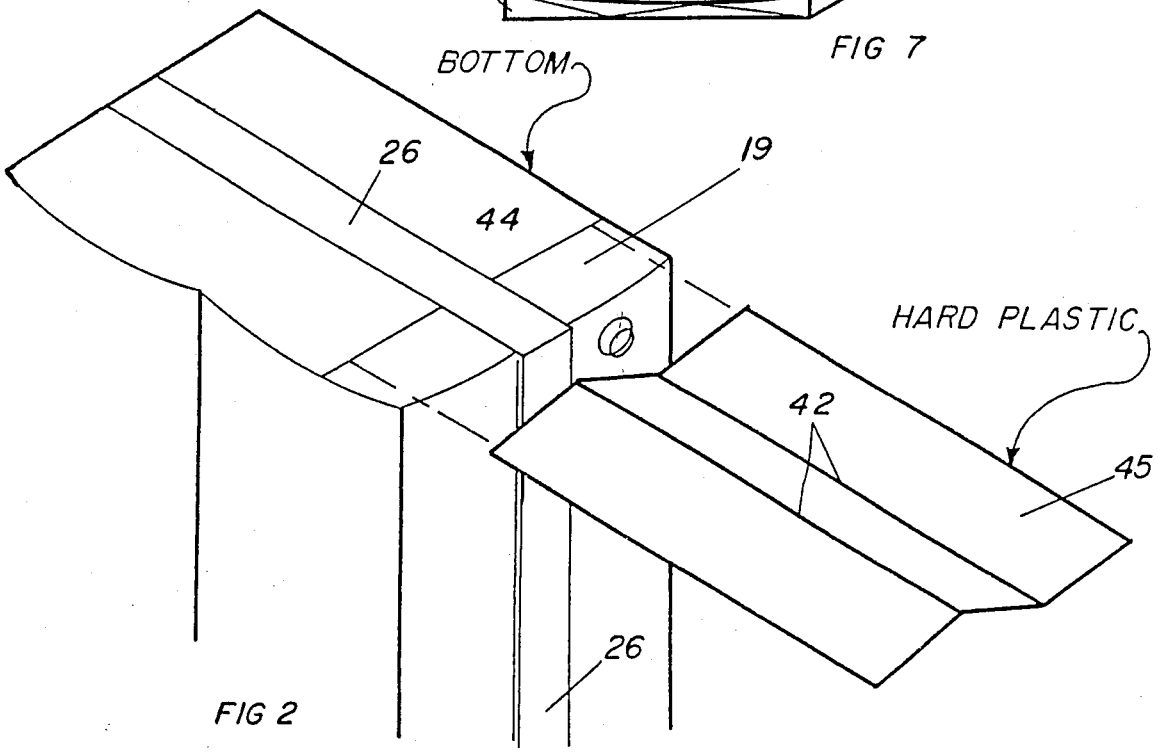
FIG. 2 is a perspective view of the bottom of the cooler, showing the manner in which a support is inserted into the bottom wall of the cooler.
Figure 3:
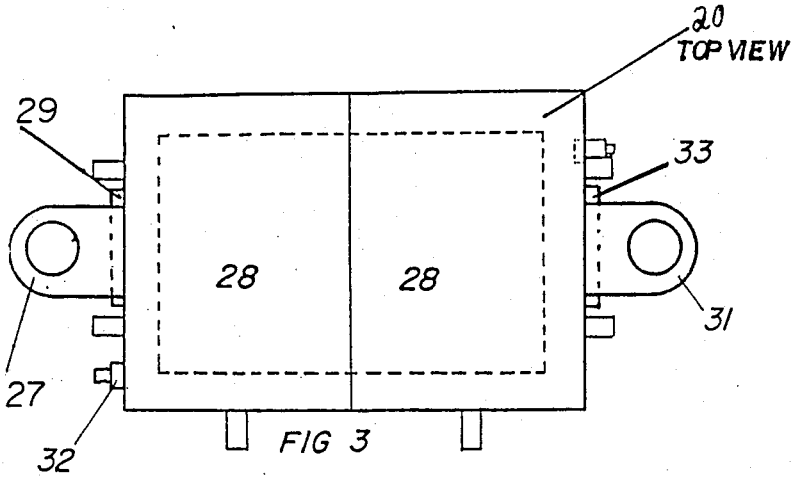
FIG. 3 is a top view of the cooler.
Figure 4:
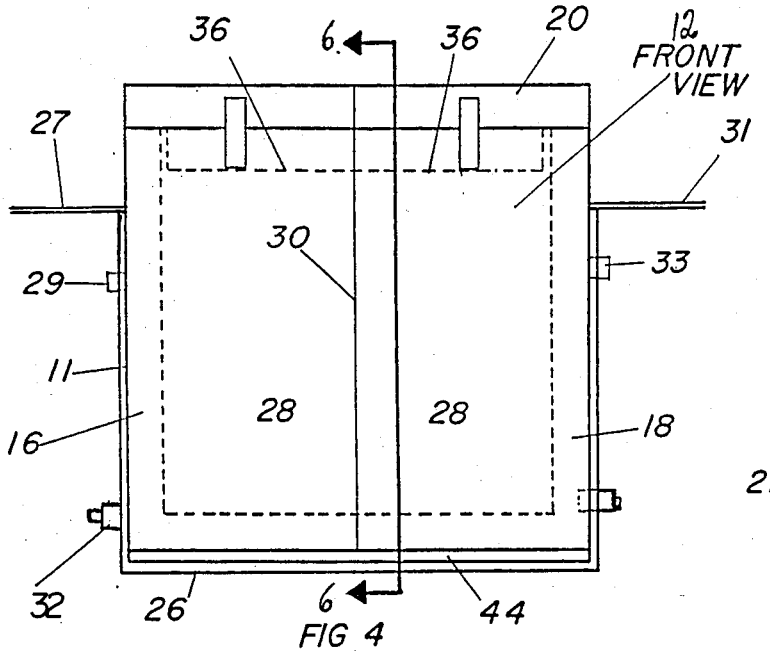
FIG. 4 is a rear view of the cooler.
Figure 5:
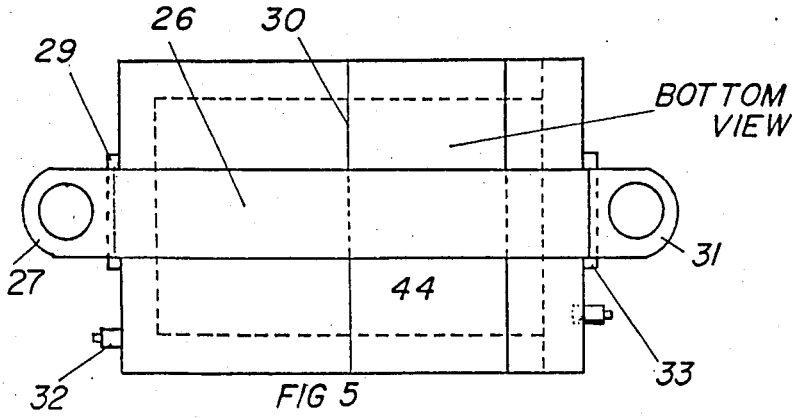
FIG. 5 is a bottom view of the cooler.

FIGS. 2 and 5 illustrate use of a foldable support 45 to reinforce the bottom wall 19 of the cooler 10. The support 45 is preferably manufactured from hard plastic, or other semi-rigid, durable material, having longitudinal creases 42 at which the support 45 can be folded. A pocket 44 for securing the support 45 is formed on the exterior of the bottom wall 19 by affixing a sheet of flexible material, similar to that used to construct the cooler 10, along the perimeter of the bottom wall 19. The support 45 resists deformation of the bottom wall 19 under the weight of the contents of the cooler and distributes the weight to the carrying strap 26.

The bottom support 45 can be permanently secured within the pocket 44 by suitable means during manufacture of the cooler 10, thereby facilitating storage of the cooler 10. Specifically, in preparation for storage following use, the cooler 10 is deflated and the support 45 and bottom wall 19 of the container 11 are folded along the longitudinal creases 42 of the support 45. The deflated container 11 and lid 20 are then either folded onto or wrapped around the folded support 45 and bottom wall 19.

To prepare for use of the cooler, the container 11 and lid 20 are unfolded, or unwrapped, and then inflated. As the container 11 fills with air, the support 45 will unfold.

Figure 8A:
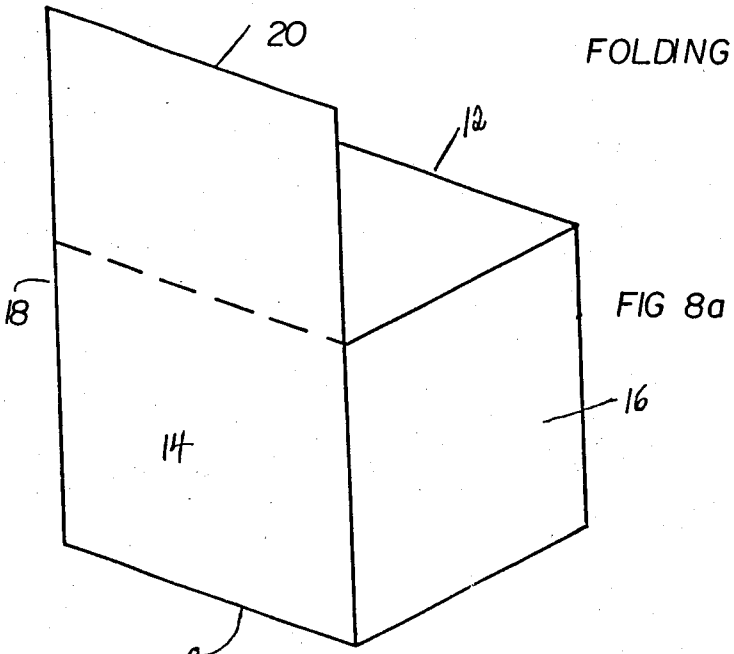
FIGS. 8*a*–8*f* include several schematic views of the cooler illustrating the manner in which the cooler is folded for storage.
Figure 8B:
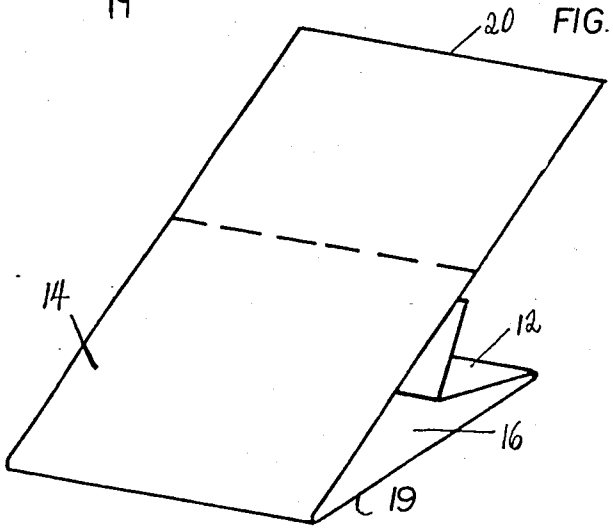
Figure 8C:
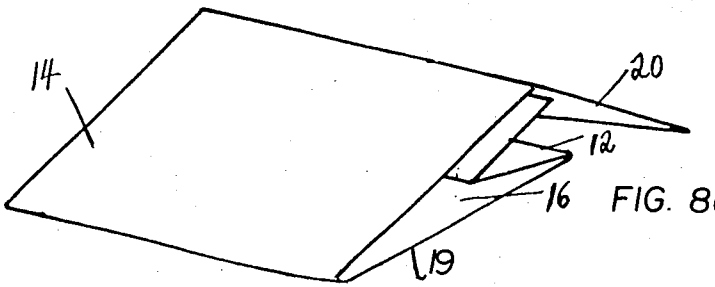
Figure 8D:
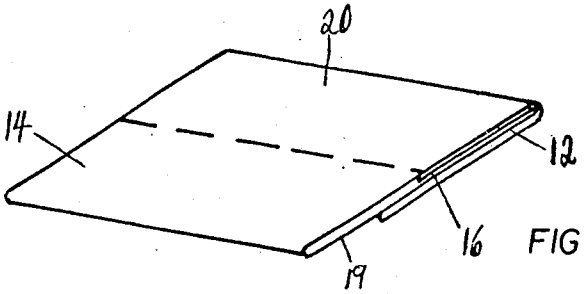
Figure 8E:
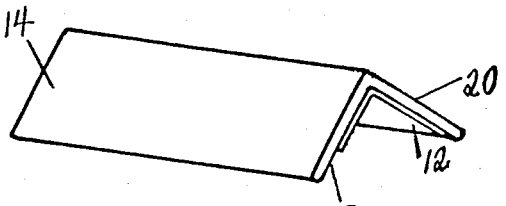
Figure 8F:
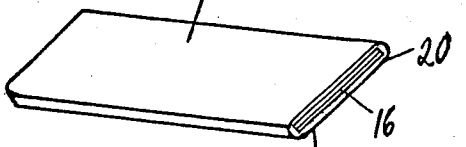

FIGS. 8*a* through 8*f* illustrates the folding process. In FIGS. 8*a* and 8*b*, the back wall 14 of an inflatable cooler 10 deflated of air collapses downward onto the deflated and collapsed bottom wall 19 as the deflated front wall 12 and side walls 16 and 18 fold inward. In FIG. 8*c* the deflated lid 20 is then folded over and around the collapsed front wall 12 and folded to the underside of the collapsed bottom wall 19. In FIG. 8*d* the support 45 collapses along one or more creases 42 extending along the support 45 as the container walls 12, 14, 16, 18 an 19 and lid 20 are deflated and folded. In FIG. 8*d*, *e* and *f*, the inflatable cooler walls 12, 14, 16, 18 and 19 and lid 20, which are collapsed onto each other, are then folded longitudinally along a crease 42 extending along the reinforcing support 45 thereby condensing the volume of the cooler 10 for storage.

In the alternative, the bottom support 45 can be removed from the pocket 44 when the cooler 10 is not in use and inserted into the pocket 44 in preparation for use. To insert the support 45, the container 11 is unfolded and inflated, the carrying strap 26 is slid to the side of bottom panel 19 and the support 45 is slid into the pocket 44. Following use of the cooler 10, the bottom support 45 is removed from the pocket 44 of the bottom wall 19. The support 45 may then be folded along the creases 42 into a reduced size. The entire cooler 10 is then deflated, folded and stored with the bottom support 45.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitutions of the parts and elements without departing from the spirit of the invention.

I claim:

1. An inflatable cooler comprising:

a container, having inflatable front and rear walls, side walls and a bottom wall, for containing and insulating articles from the surrounding environment;

an inflatable lid for covering the top of the container and for providing additional insulation from the surrounding environment;

valve means for introducing and removing air from the container and lid; and a reinforcing support member secured to the bottom wall of the container for providing additional support to articles carried within the container, wherein the support member is a plate of semi-rigid material foldable along crease means extending across the support member.

2. The inflatable cooler of claim 1 wherein the inflatable lid is secured by a hinge to the upper end of the inflatable container.

3. The inflatable cooler of claim 1 further comprising a carrying strap extending about the bottom wall and side walls of the container, wherein the weight of objects within the container is supported by the reinforcing member and the carrying strap.

4. The inflatable cooler of claim 1 further comprising a pocket formed on the exterior of the bottom wall for securing the support member to the bottom wall.

5. The inflatable cooler of claim 4 wherein the support member is removable from the pocket formed on the bottom wall for storage.

6. The inflatable cooler of claim 1 further comprising support strips secured within the inflatable container and lid for preventing excessive inflation of the container and lid and for maintaining a desired shape when the container and lid are inflated.

7. The inflatable cooler of claim 6 wherein the support strips form apertures for allowing passage of air through the container and lid when the cooler is inflated and deflated.

8. An inflatable cooler comprising:

an inflatable container forming a chamber for containing and insulating articles and having interior and exterior surfaces separated by an air space when inflated;

an inflatable lid for covering and insulating the container chamber and having a lower and an upper surface separated by an air space when inflated;

valve means for allowing addition and removal of air from the lid and container during inflation and deflation of the cooler;

a semi-rigid reinforcing support plate secured to the bottom wall of the container for supporting the contents of the container wherein the reinforcing plate is secured to the exterior surface of the bottom wall of the container and is foldable for storage about crease means extending along the plate; and support strips secured between the inner and outer surfaces of the container for maintaining a desired shape of the container when the cooler is inflated.

9. The inflatable cooler of claim 8 wherein the support strips include one or more apertures for allowing passage of air through the container when the container is inflated and deflated.

10. The inflatable cooler of claim 8 further comprising fastening means for releasably securing the reinforcing plate to the exterior surface of the bottom wall to allow removal of the reinforcing plate from the cooler for storage.

11. The inflatable cooler of claim 10 further comprising a carrying strap secured to the side walls of the container and about the bottom wall of the container for supporting the contents of the container and the reinforcing plate when the cooler is carried and for securing the reinforcing plate against removal from the fastening means.

12. The inflatable cooler of claim 11 wherein the fastening means comprises a pocket formed on the exterior surface of the bottom wall of the container for holding the reinforcing plate.

13. The inflatable cooler of claim 12 wherein the walls and lid collapse when air is removed during deflation.

14. The inflatable cooler of claim 13 wherein the deflated container back wall folds downward onto the deflated and collapsed bottom wall as the deflated front and side walls fold inward.

15. The inflatable cooler of claim 14 wherein the deflated lid is folded over and around the collapsed front wall and folded to the underside of the collapsed bottom wall.

16. The inflatable cooler of claim 15 wherein the reinforcing plate is collapsed along crease means extending along the plate as the container walls and lid are deflated and folded.

17. The inflatable cooler of claim 15 wherein, the reinforcing plate is removed from the bottom wall and collapsed along crease means extending along the plate.

18. The inflatable cooler of claim 16 wherein the deflated walls and lid collapsed onto each other are folded longitudinally along the crease means extending along the reinforcing plate thereby condensing the volume of the cooler for storage.

19. The inflatable cooler of claim 17 wherein the deflated walls and lid collapsed onto each other are folded over the collapsed reinforcing plate thereby condensing the volume of the cooler for storage.

* * * * *